United States Patent [19]

Eady

[11] Patent Number: 4,951,335

[45] Date of Patent: Aug. 28, 1990

[54] MATTRESS ASSEMBLY

[75] Inventor: Donald Geoffrey Eady, West Vancouver, Canada

[73] Assignee: Donan Marketing Corporation, North Vancouver, Canada

[21] Appl. No.: 361,310

[22] Filed: Jun. 5, 1989

[51] Int. Cl.[5] ..... A47C 27/08

[52] U.S. Cl. ..... 5/450; 5/453; 5/455; 5/470; 5/449

[58] Field of Search ..... 5/453, 455, 449, 470, 5/448

[56] References Cited

U.S. PATENT DOCUMENTS

| | | | |
|---|---|---|---|
| 772,602 | 10/1904 | Bartlett | 5/448 |
| 3,872,525 | 3/1975 | Lea et al. | 5/453 |
| 4,306,322 | 12/1981 | Young et al. | 5/449 |
| 4,394,784 | 7/1983 | Swenson et al. | 5/453 |
| 4,435,864 | 3/1984 | Callaway | 5/457 |
| 4,809,375 | 3/1989 | Bull | 5/470 |
| 4,829,616 | 5/1989 | Walker | 5/453 |
| 4,890,344 | 1/1990 | Walker | 5/455 |
| 4,897,890 | 2/1990 | Walker | 5/455 |

FOREIGN PATENT DOCUMENTS

| | | | |
|---|---|---|---|
| 2012159 | 7/1979 | United Kingdom | 5/484 |

*Primary Examiner*—Alexander Grosz
*Attorney, Agent, or Firm*—Shlesinger & Myers

[57] ABSTRACT

A mattress includes a lower portion having an inflatable member and a pile overlay on top of the lower portion. There is a zip fastener or the like for releasably securing the overlay to the lower portion. There may be padding between the top of the inflatable member and pile overlay. The padding may include a layer of woolen knops. The inflatable member may include an air-impermeable shell, a self-expanding open cell foam core within the shell and a threaded connector or the like for admitting air into the member and for expelling air from the member.

7 Claims, 1 Drawing Sheet

MATTRESS ASSEMBLY

BACKGROUND OF THE INVENTION

This invention relates to an inflatable mattress assembly.

Inflatable mattresses have been developed in the past and are typically used for camping or for occasional use with overnight guests. The usual inflatable mattress is a simple balloon—like structure with a relatively rugged air impermeable shell having one or more internal chambers. Such mattresses have the advantage of simplicity and low cost, but do not provide the degree of comfort expected by many people. In addition, they can be relatively slippery such that the sleeper may slide off the mattress unconsciously.

A less common, but still widely sold type of air mattress, is the self-inflating type. These air mattresses are much thinner than those described above and require no pump to inflate them. They are very compact and are suitable for backpacking purposes in particular. These mattresses include an air-impermeable shell which typically includes an upper portion and a lower portion which are welded together about the perimeter of the mattress. An open-cell foam member is contained within the shell and is preferably bonded thereto. For example, the outer shell may comprise a fabric coated internally with a resin which provides air-impermeability and, when heated, can bond the upper portion of the shell to the lower portion of the shell about the perimeter by means of a T-joint. A valve is provided which selectively permits air to enter or leave the interior of the shell. Such mattresses are usually stored in a deflated condition where the inner foam member is compressed to a very small volume between the two portions of the shell. The mattress then can be rolled to a very compact package. The valve is closed to prevent the mattress from inflating. The mattress is prepared for use by unrolling it and opening the valve. The expanding foam draws air into the mattress. Sometimes a small volume of air is added by means of the user's mouth so the mattress achieves the required degree of inflation.

The use of the interior foam member bonded to the interior of the shell means that the mattress can be relatively thin compared with the first type of air mattress identified above, without the weight of a sleeper compressing the mattress completely in any particular location. The inner foam member tends to spread out any force applied to the mattress from above.

However, these self-inflating air mattresses still do not provide the degree of comfort comparable to a high quality conventional mattress and, again, are frequently slippery so the user tends to slide off the mattress during the night.

Good quality, conventional mattresses provide an appreciably greater degree of comfort than either of the inflatable mattresses described above. However, they are heavy and bulky and, in particular, take up a considerable volume of space in a retail outlet. For this reason, it is not possible for many stores to stock a large number of mattresses. In some cases, only floor models are on display and actual mattresses for the consumer must be shipped from a warehouse location. In addition, such mattresses are difficult to move from location to location if, for example, the user changes residence. Finally, such mattresses are not adjustable in any manner. A user must select a mattress in a store and sometimes the user ultimately finds the mattress too hard or too soft when it is too late to return it. Also, the individual requirements of two persons sharing a bed cannot be addressed.

In short, there is a demand for a compact mattress which offers a high degree of comfort, yet can be stored at a retail location in a relatively small space. Preferably such a mattress should offer adjustable comfort depending upon the desires of the users with respect to hardness or softness.

SUMMARY OF THE INVENTION

One aspect of the invention provides a mattress with a lower portion having an inflatable member. There is a pile overlay on top of the lower portion and means for releasably securing the overlay to the lower portion.

The means for releasably securing may be a zip fastener having complementary portions extending about the perimeter of the lower portion and the overlay.

The mattress may also include padding between the top of the inflatable member and the top of the shell. For example, the padding may comprise a layer of woolen knops.

The inflatable member may include an air-impermeable shell, a self-expanding open-cell foam core within the shell which is bonded thereto and means for admitting air into the member and for expelling air from the member. For example, the means for admitting and expelling air may include a pump. There may also be means to reverse the pump to harden the mattress by admitting air into the inflatable member or to soften the mattress by expelling air from the inner member.

DESCRIPTION OF THE PREFERRED EMBODIMENTS

Figure 1:
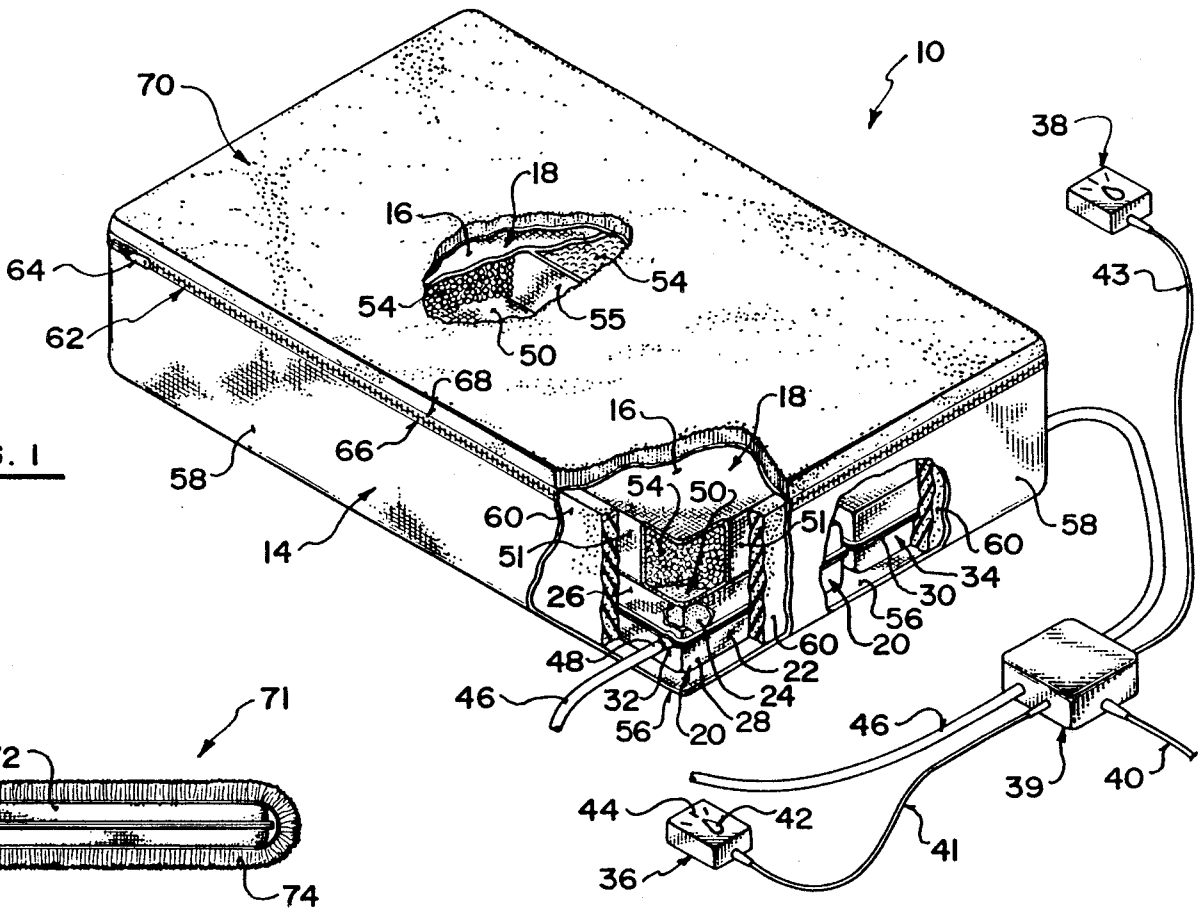
FIG. 1 is partly broken away, isometric view of a mattress assembly according to an embodiment of the invention.

Referring to FIG. 1, this illustrates a mattress assembly 10 according to an embodiment of the invention. The mattress assembly includes a lower portion 14 with a top surface 16 which comprises the top of a cotton sheet 18 in this embodiment.

The lower portion also includes a first inflatable member 20. In this example the inflatable member includes an air impermeable shell 22 and a self-expanding, open-cell foam core 24 within the shell. The shell in this example is of nylon fabric and comprises two sheets of the fabric forming top portion 26 and bottom portion 28 thereof. The fabric is air-impermeable in the preferred embodiment because of an internal coating of a resin. The top portion and bottom portion are bonded at a T-seam extending about the middle of the inflatable member. The seam is bonded and sealed by heating the seam and pressing the top Portion and bottom portion together along the seam, thereby bonding the resin of the top portion and bottom portion together.

The inner core is of a suitable open-celled foam, polyurethane foam in this particular case. The top portion and bottom portion of the shell are bonded to the exterior of the foam core by pressing the shell against the foam core while applying heat.

The inflatable member 20 is provided with means for admitting air into the member and for expelling air from the member, in this case a threaded tube 32. In the preferred embodiment, there is a second inflatable member 34 arranged adjacent the first inflatable member 20 such that each occupies approximately one-half the width of the mattress assembly. The illustrated example is a double size mattress assembly. The second inflatable member is identical to the first and therefore is not described in further detail. Foam strips (not shown) may be positioned between the inflatable members and co-extensive with the heights thereof so that two standard widths of inflatable members, 24" and 33" can be used for all standard size mattresses. One 33" member is used for twin size, two 24" for double size, two 24" with a 4" foam strip for Queen size and two 33" with a 4" strip for King size. The remaining width is achieved using foam layer 60 on the sides of the mattress as assembly described below in more detail.

The assembly includes two identical controls 36 and 38 for the two inflatable members 20 and 34 respectively. These controls are both connected to a single compressor/vacuum pump 39 by cables 41 and 43 respectively. The pump is driven by a reversible electric motor (not shown) supplied by electricity through power cord 40. Controls 36 and 38 are identical so only controls 36 is described in detail. A control lever 42 on the top of control 36 has three positions indicated by indicia 44. The centre position renders the pump non-operative. The position to one side of centre drives the pump so as to supply air to the inflatable member 20 through air hose 46 and threaded connector 48 which engages tube 32. Moving lever 42 in the opposite direction operates the pump in the reverse direction to draw air from the inflatable member. Consequently, the mattress assembly can be made harder by operating the pump to provide more air to the inflatable member and made softer by removing air from the inflatable member with reverse operation of the pump. Providing two separate inflatable members and two separate controls means that two persons occupying the mattress can adjust the hardness of the mattress assembly according to his or her own requirements. A single control could be used instead with switches for the two inflatable members. Alternatively, instead of two inflatable members, the assembly may include a single inflatable member and a single control if desired. As a further alternative, the controls and pumps may be omitted and the mattresses can be hardened or softened by using the mouth to add or draw air from threaded connector 48 and then sealing it with a threaded cap, or valve for example.

The mattress assembly has padding on top of the inflatable members in this case, a layer of woollen knops 54. These knops are loose and somewhat irregular shape and are silicone coated in the preferred embodiment. They are highly compressable, resiliant and give a considerable degree of comfort to the user. They are commercially available under the trade mark INSULANA from Woolfill New Zealand of Christchurch, New Zealand. The knops are contained within a flat bag formed by fabric sheet 18 on top and a similar sheet 50 on bottom connected by sides 51. The sheets 50 and 18 are sewn to the sides to form the closed bag. The bag has interior baffles 55, only one of which is partially shown, to keep the knops evenly distributed. Carded wool may be used instead of the knops and without baffles.

The outer sides of the lower portion 14 are formed by cotton fabric ticking 58 extending about the perimeter of the lower portion. The ticking 58 is separated from inflatable members 20 and 34, and the layer of woollen knops 54 by a foam layer 60 extending about all four sides of the mattress from sheet 18 on top to sheet 50 on the bottom. The foam is polyurethane foam in this example is about 3" thick on twin and double size mattresses and 4" thick on larger sizes. The foam layer improves rigidity of the mattress assembly on the sides. A cotton sheet 56 is sewn to the bottom of the ticking below inflatable members 20 and 34. The ticking, foam layer and sheet 56 form a shell containing the inflatable members.

A zip fastener 62 extends about the perimeter of the lower portion 14 on the top thereof and has a lower portion 66 sewn to the top of the ticking 58. The zip fastener is provided with a closure device 64.

Top portion 68 of the zip fastener is sewn to the perimeter of a pile overlay 70 resting on top of the lower portion 14 of the assembly and forming the top of the assembly. The overlay is of a material commercially available from a number of sources and includes a cloth backing of wool, cotton or synthetic fibre and a wool pile on the top thereof, giving the appearance of a natural sheepskin. Material for the overlay is at present made by the Slivernitt process by Fleece Products of Sydney, Australia, for example.

Operation

The mattress assembly 10 would normally be supplied to the consumer in a folded or rolled condition with the inflatable members 20 and 34 deflated and with the assembly compressed to form a relatively compact package for storage and sale purposes. This condition is facilitated by the compressable nature of the assembly, particularly by removal of the air from the inflatable members and by compression of the layer of woollen knops 54.

The purchaser typically removes the assembly from the packaging and unfolds it and lays it flat. The layer of woollen knops 54 naturally expands to provide suitable padding. The pump 39 is connected to the controls 36 and 38 and to the respective inflatable members and air is admitted into the inflatable members using the controls on the pumps. The controls are normally positioned on a night table or the like adjacent each side of the bed so that each sleeper can adjust the hardness of the mattress assembly to his or her own preference.

Alternatively the air may be admitted into the inflatable members by allowing them to self expand and making desired adjustments by mouth.

The pile overlay 70 is releasably connected to the lower portion 14 of the assembly by the zip fastener 62 so that the overlay can be removed for cleaning.

Alternative Embodiment

Figure 2:
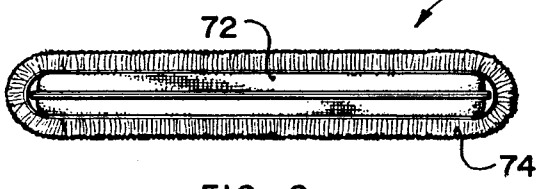
FIG. 2 is a sectional view of a mattress assembly according to another embodiment of the invention.

FIG. 2 shows a simpler mattress assembly 70 according to the invention which still retains some of the advantages of comfort and small storage size. Here, a self-inflating air mattress 72 of the type described above is positioned within a sleeve-like wool pile overlay 74. The overlay adds a considerable degree of comfort while eliminating any slippery characteristic of the air mattress. A pump, similar to those described above is optional.

Changes and modifications in the specifically described embodiments can be carried out without departing from the scope of the invention which is intended to be limited only by the scope of the appended claims.

What is claimed is:

1. A mattress, comprising:

a lower portion having an inflatable member wherein said lower portion includes a shell having a top, a bottom and sides extending upwardly from the bottom, the inflatable member being within the shell;

a pile overlay on top of said lower portion;

padding between the top of a substantial portion of the inflatable member and the pile overlay, said padding comprising a layer of silicone coated woolen knops contained within a flat, baglike enclosure;

means for releasably ,securing the overlay to the lower portion; and a foam layer extending about sides of the mattress inside the shell, wherein said mattress is capable of being compressed and rolled up when said inflatable member is deflated.

2. A mattress as claimed in claim 1, wherein the means for releasably securing is a zip fastener having complementary portions extending about the perimeter of the lower portion and the overlay.

3. A mattress as claimed in claim 1, wherein the padding comprises a layer of carded wool between the knops and the inflatable member.

4. A mattress as claimed in claim 1, wherein the inflatable member includes an air-impermeable shell, a self-expanding open-cell foam core within the shell and bonded thereto and means for admitting air into the member and for expelling air from the member.

5. A mattress as claimed in claim 4, wherein the means for admitting and expelling air includes an air pump.

6. A mattress as claimed in claim 5, further including means to reverse the pump to harden the mattress by admitting air into the inflatable member or to soften the mattress by expelling air from the inner member.

7. A mattress as claimed in claim 1, wherein the overlay is sleeve-like, the inflatable member being within the sleeve.

* * * * *